US005922394A

United States Patent [19]

Trapani et al.

[11] Patent Number: 5,922,394

[45] Date of Patent: Jul. 13, 1999

[54] METHOD FOR PRODUCING LUMINISCENT SCREEN

[75] Inventors: Andrew Paul Trapani, Valbonne, France; Gary Robert Larson, Hatfield, Pa.; Steven Charles Brown, Pottstown, Pa.; David William Whitman, Sumneytown, Pa.

[73] Assignee: Rohm and Haas Company, Philadelphia, Pa.

[21] Appl. No.: 08/825,279

[22] Filed: Mar. 27, 1997

[30] Foreign Application Priority Data

Apr. 1, 1996 [FR] France ..... 96 04063

[51] Int. Cl.[6] ..... B05D 5/06

[52] U.S. Cl. ..... 427/64; 427/68; 427/226; 427/230; 427/385.5; 427/162; 427/389.7; 427/404; 427/407.1; 427/407.2; 445/24

[58] Field of Search ..... 427/64, 68, 226, 427/230, 385.5, 162, 389.7, 404, 407.1, 407.2; 445/24

[56] References Cited

U.S. PATENT DOCUMENTS

| | | | |
|---|---|---|---|
| 3,067,055 | 12/1962 | Saulnier . | |
| 3,269,838 | 8/1966 | Saulnier . | |
| 3,317,337 | 5/1967 | Saulnier . | |
| 3,574,663 | 4/1971 | Schniepp . | |
| 3,579,367 | 5/1971 | Patel . | |
| 3,582,390 | 6/1971 | Saulnier . | |
| 3,703,401 | 11/1972 | Deal et al. . | |
| 3,981,729 | 9/1976 | Saulnier | 427/64 |
| 4,123,563 | 10/1978 | Mitobe et al. | 427/68 |
| 4,139,657 | 2/1979 | Watanabe | 427/68 |
| 4,339,475 | 7/1982 | Hinosugi et al. | 427/64 |
| 4,954,366 | 9/1990 | Pezzulo et al. | 427/68 |
| 4,990,366 | 2/1991 | Pezzulo et al. | 427/64 |
| 5,073,463 | 12/1991 | Fujita | 427/64 |
| 5,141,461 | 8/1992 | Nishimura et al. | 427/68 |
| 5,145,511 | 9/1992 | Patel et al. | 65/42 |

FOREIGN PATENT DOCUMENTS

| | | |
|---|---|---|
| 0735008A2 | 2/1996 | European Pat. Off. . |
| 0735561A2 | 2/1996 | European Pat. Off. . |

*Primary Examiner*—Janyce Bell
*Attorney, Agent, or Firm*—Guy T. Donatiello; Sudhir G. Deshmukh

[57] ABSTRACT

The present invention is directed to producing a luminescent screen used in a cathode ray tube (CRT) suitable for monochromatic or chromatic images, such as, those utilized in televisions, computers or data monitoring equipment, which require CRTs. The method of the present invention produces an ablative layer of the luminescent screen having a smooth surface with reduced surface distortions, such as, streaks and waviness, which are typically produced by conventional coating processes. When a reflective aluminum film is deposited on such a smooth ablative layer, the reflective aluminum film is also provided with a smooth surface, since it typically conforms to the underlying smooth surface of the ablative layer. As a result, CRT images having reduced distortions are produced. The method of the present invention further provides for enhancing the brightness of CRT images, which results from utilizing low ash producing polymers in the ablative layer and the binder of a luminophor layer of the luminescent screen. The method of the present invention further provides for combining the step for volatilizing of the ablative layer and the binder in the luminophor layer with the step for cementing of the face plate of CRT with the cone of CRT, without adversely affecting the quality of the hermitic seal between the face plate and the cone.

8 Claims, No Drawings

METHOD FOR PRODUCING LUMINISCENT SCREEN

This is a nonprovisional application of prior pending provisional French application Ser. No. 96 04063, filed Apr. 1, 1996.

The present invention generally relates to producing a metallized luminescent screen of a cathode-ray tube (CRT) and more particularly to a metallized luminescent layer, which produces an image with enhanced image brightness and reduced image distortion.

The luminescent screen of a color CRT includes a luminophor layer positioned on a face plate of a CRT. The luminophor layer means a layer that produces electroluminescent light when subjected to cathode rays. Such a layer typically includes an ordered array or pattern of a number of deposits of phosphors. In the most conventional case, featuring three colors, the phosphors are deposited in the form of dots or stripes arranged to define triads throughout the inner surface of a face plate of CRT; each triad includes a red light emitting phosphor in the form of a dot or a stripe, blue light emitting phosphor in the form of a dot or a stripe and green light emitting phosphor in the form of a dot or a stripe. The process for producing the luminophor layer is known in the art, such as, for example, the process taught in the U.S. Pat. No. 3,269,838. To produce the ordered array, a coating of an aqueous slurry containing phosphor particles of a desired color and a binder, such as, an aqueous dispersion of acrylic polymer, is applied on the inner surface of the glass face plate of CRT. Such a layer is then conventionally coated with a photosensitizer, which is well known in the art, and then exposed through a photo mask to actinic light. The unexposed photo resist coating is then removed by conventional developer solution and the uncovered phosphor layer underneath is etched away by immersion in a conventional etching solution. The process is repeated for depositing particles of phosphors of each color in the form of a dot or stripe to produce the ordered array, which is then typically dried by subjecting it to radiant heat.

A thin reflective film of a metallic aluminum is then deposited on the exposed surface of the luminophor layer. This film, typically of the order of 1000 to 5000 Angstroms, is sufficiently thin to permit a modulated pattern of an electron beam (cathode ray) produced by an electron gun positioned at the other end of CRT to pass through the film without scattering or loss of beam intensity. The pattern of the electron beam after passing through the aluminum film, strikes the luminophor layer to produce electroluminescent light, which appears to a viewer as an image. The reflective aluminum film acts as a mirror that prevents the backward-emitted light produced by the luminophor layer from being lost to the interior of CRT and reflects the light outward to the viewer after passing through the glass face plate of CRT. As a result, the image quality and brightness is significantly improved.

The exposed surface of the luminophor layer tends to be irregular for a variety of reasons, including variations in particle size of phosphor material used in producing the luminophor layer. Thus, if a reflective film of metallic aluminum were to be deposited by the well-known technique of vaporizing an aluminum pellet, the aluminum film resulting therefrom would have a highly irregular surface since it would tend to conform to the surface contour of the luminophor layer. Irregularities in the aluminum film destroy the desired property of specular reflection of the pattern of the electron beam passing therethrough. Such irregularities are highly undesired. Moreover, there is a distinct possibility that the aluminum film while its being deposited, would penetrate the interstices of the luminophor layer and would undesirably deposit in and around the phosphor particles.

In order to avoid these difficulties, the art generally applies over the luminophor layer, an ablatable layer of organic polymer material, which then presents a smooth exposed surface upon which the metallic aluminum film may be received. The ablatable material is an organic material that can be readily volatilized when subjected to heating, such as, by baking at about 380° C. to 450° C. Such an ablatable layer permits the metallic aluminum film deposited thereon to be smooth. As a result, the distortion in image resulting therefrom is reduced and the penetration of the aluminum deposit within the intestacies of the phosphor deposits is substantially prevented. Furthermore, the ablatable layer can be expeditiously removed by subjecting the ablatable layer to heat, once the metallic aluminum film is deposited on it. Typically such an ablatable layer includes one or more layers of a film-forming acrylic polymer in the form of an aqueous colloidal dispersion or powder. Such an ablatable layer may be applied over the luminophor layer by spraying the acrylic polymer in the form of a powder, all aqueous dispersion or preferably by coating the luminophor layer with an aqueous dispersion of the film-forming acrylic polymer. Such coating methods are known in the art, some of which are described in the U.S. Pat. Nos., 3,067,055, 3,583,390, 4,954,366 and 4,990,366.

Once the ablatable layer is removed by the volatilization process, the edge of the face plate is coated with a sealant, such as, frit. A cone of CRT is then positioned over the sealant and the assembly is subjected to a baking step for cementing the cone to the face plate of CRT to achieve a hermitic seal between the face plate and the cone.

One of the problems associated with the quality of image produced by the CRT, is the presence of distortion in such images. It is known in the art that the presence of irregularities, such as cracks and blisters, in the reflective aluminum film tend to create distortions in the images resulting from using such as a luminescent layer. One approach described in the U.S. Pat. No. 3,579,367 provides for a double layer of heat removable acrylic resins, in which a softer inner layer vaporizes at a lower temperature than the outer harder layer when subjected to a baking step. Thus, by controlling the vaporization of the organic material beneath the aluminum film deposited thereon, such vaporized organic materials pass through the aluminum film without rupturing or destroying the aluminum film. As a result, a substantially continuous aluminum film is obtained over the phosphor layer. Thus, by utilizing a double layer of organic heat-removable material over a phosphor layer of the luminescent screen, an attempt is made to produce an aluminum reflective film with reduced cracks or blisters. However, there exists a need for producing a reflective aluminum film that is substantially free from distortions, such as, surface waviness and streaks. The method of the present invention solves this problem by providing an ablative layer that is substantially free from surface distortions, such as, streaks and surface waviness, so that, when a reflective aluminum film conforming to the ablative layer is deposited on such an ablative layer, the film is provided with a surface that is substantially free from distortions.

The present invention is directed to a method for reducing surface distortions in a reflective aluminum film of a luminescent layer of a CRT comprising:

coating a luminophor layer deposited on a face plate of said CRT with an ablative layer of an aqueous dispersion of acrylic polymer particles having a particle size in the range of 180 to 450 nanometers for reducing surface distortions on said ablative layer; and depositing said reflective aluminum film on said ablative layer, wherein said reflective film conforms to said ablative layer.

Another problem associated with the quality of image produced by CRT, is the degree of the image brightness achieved. One approach is described in the U.S. Pat. No. 3,582,390 wherein minor amounts of hydrogen peroxide and a water-soluble polymer in a water-based emulsion containing greater amounts of acrylate resins were used to increase light output produced by CRT. However, there is no recognition in the cited art of the effect on the image brightness that results from the presence of ash in the polymers used in the binder of the luminophor layer or the ablative layer. The inventors have unexpectedly discovered that by reducing the ash content in the ablative layer and, if desired, in the luminophor layer, the brightness of the image of produced by the CRT is enhanced.

Therefore, the present invention is further directed to volatilizing said ablative layer, wherein said acrylic polymer particles comprise combustible components for reducing ash content in said luminescent layer and if further desired by utilizing a combustible acrylic binder in said luminophor layer to produce said luminescent layer having reduced ash content.

Another aspect of the method of present invention includes baking a luminescent layer of a CRT applied along the inner surface of a face plate of said CRT comprising:

applying a sealant along the edge of said face plate of said CRT and then positioning a CRT cone of said CRT thereon;

volatilizing a binder in a luminophor layer of said luminescent layer and an ablative layer of said luminescent layer at a baking temperature below the softening point of said sealant; and raising said baking temperature above the softening point of said sealant to cement said cone to said face plate to produce said CRT.

As used herein:

"GPC weight average molecular weight" means the weight average molecular weight determined by gel permeation chromatography (GPC) which is described on page 4, Chapter I of The Characterization of Polymers published by Rohm and Haas Company, Philadelphia, Pa. in 1976, utilizing polymethyl methacrylate as the standard. The GPC weight average molecular weight can be estimated by calculating a theory number average molecular weight. In systems containing chain transfer agents, the theory weight average molecular weight is simply the total weight of polymerizable monomer in grams divided by the total molar amount of chain transfer agent used during the polymerization. Estimating the molecular weight of an emulsion polymer system that does not contain a chain transfer agent is more complex. A cruder estimate can be obtained by taking the total weight of polymerizable monomer in grams and dividing that quantity by the product of the molar amount of an initiator multiplied by an efficiency factor (in our persulfate initiated systems, we have used a factor of approximately 0.5). Further information on theoretical molecular weight calculations can be found in *Principles of Polymerization* 2nd edition, by George Odian published by John Wiley and Sons, N.Y., N.Y. in 1981 and in *Emulsion Polmerization* edited by Irja Pirma published by Academic Press, N.Y., N.Y. in 1982.

"Glass transition temperature (Tg)" is a narrow range of temperature, as measured by conventional differential scanning calorimetry (DSC), during which amorphous polymers change from relatively hard brittle glasses to relatively soft viscous rubbers. To measure the Tg by this method, the copolymer samples were dried, preheated to 120° C., rapidly cooled to −100° C., and then heated to 150° C. at a rate of 20° C./minute while data was being collected. The Tg was measured at the midpoint of the inflection using the half-height method. Alternatively, the reciprocal of the glass transition temperature of a particular copolymer composition may typically be estimated with a high degree of accuracy by calculating the sum of the respective quotients obtained by dividing each of the weight fractions of the respective monomers, $M_1$, $M_2$, . . . $M_n$, from which the copolymer is derived by the Tg value for the homopolymer derived from the respective monomer, according to an equation of the form:

$$1/T_{g(copolymer)} = \sum_{i=1}^{n} w_{(Mi)} / T_{g(Mi)} \quad (1)$$

wherein:

Tg(copolymer) is the estimated glass transition temperature of the copolymer, expressed in ° Kelvin (° K.);

w(Mi) is the weight fraction of repeat units in the copolymer derived from an $i^{th}$ monomer $M_i$; and Tg(Mi) is the glass transition temperature, expressed in ° Kelvin (° K.), of the homopolymer of an $i^{th}$ monomer $M_i$.

The glass transition temperature of various homopolymers may be found, for example, in "Polymer Handbook", edited by J. Brandrup and E. H. Immergut, Interscience Publishers.

"Polymer particle size" means the diameter of the polymer particles measured by using a Brookhaven Model BI-90 Particle Sizer supplied by Brookhaven Instruments Corporation, Holtsville, N.Y., which employs a quasi-elastic light scattering technique to measure the size of the polymer particles. The intensity of the scattering is a function of particle size. The diameter based on an intensity weighted average is used. This technique is described in Chapter 3, pages 48–61, entitled *Uses and Abuses of Photon Correlation Spectroscopy in Particle Sizing* by Weiner et al. in 1987 edition of American Chemical Society Symposium series.

"Ash content" means the amount of ash, expressed in weight percentage based on the total weight of polymer solids, that remains when polymer is subjected to volatilization.

"Softening Point" means a temperature at which a glass sealant deforms due to the pressure exerted by its own weight.

In one aspect of the method of the present invention, the inventors have unexpectedly discovered that by controlling the particle size of polymer particles dispersed in an aqueous dispersion used in producing the ablative layer, a substantially significant improvement in the smoothness of the surface is achieved. When a coating of an aqueous dispersion of polymer particles having the particle size in the range of from 180 to 450 nanometers, preferably in the range of from 180 to 350 nanometers and most preferably in the range of 200 to 320, is applied over the luminophor layer, surface distortions, such as, streaks, surface waviness, cracks, and blisters on the surface of the resultant ablative layer are substantially reduced. When the reflective aluminum film is deposited by well known means, such as, vacuum metallization or chemical vapor deposition on such a smooth ablative layer, the resulting surface of the reflective film, which conforms to the surface of the underlying ablative layer is also significantly improved. Such a smooth reflective aluminum film having reduced surface distortions thereon produces images that have reduced distortions.

In another aspect of the method of the present invention, the inventors have unexpectedly discovered that by utilizing combustible polymer particles in the ablative layer or utilizing a combustible acrylic binder in the luminophor layer, ash content of the resulting ablative and the luminophor layers, respectively, is substantially reduced, when these layers are subjected to the volatilizing step. As a result, by reducing the ash content from the ablative and the luminophor layers, the brightness of the image produced by the luminophor layer is enhanced. It is believed, without reliance thereon, that by reducing the ash content in the luminophor layer, the amount of scattering or absorption of the pattern of the electron beam and the electroluminescent light by the ash present in the luminophor and ablative layers is also proportionally reduced. As a result, the brightness of the image produced by CRT is enhanced.

The inventors have discovered that the combustible polymer particles in the ablative layer or the combustible acrylic binder in the luminophor layer can be produced by substantially eliminating ash from polymer components, such as, surfactants, buffers, initiators, biocides and monomers utilized in producing the aqueous dispersion of the polymer particles used in the ablative layer or the acrylic binder of the luminophor layer. The combustible polymer particles in the ablative layer or the combustible acrylic binder in the luminophor layer result from eliminating from polymer components metal ion containing surfactants or monomers that tend to crosslink.

The combustible polymer particles in the aqueous dispersions used in producing the ablative layer or the combustible acrylic binder used in producing the luminophor layer are preferably homopolymers or copolymers that tend to burn cleanly with substantially low ash content when subjected to the volatilization step. Polymers suitable for use in the present invention, generally have a weight average molecular weight in the range of 100,000 to 10,000,000 and are prepared from monomers of the following formula:

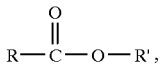

where R is a vinyl group and R' is a linear or branched functionality having a $C_2$ to $C_{20}$, preferably $C_3$ to $C_{20}$, chain length. Some of the preferred such polymers include homopolymers or copolymers of at least one ethylenically unsaturated monomer, such as, for example, methacrylic ester monomers including ethyl methacrylate, propyl methacrylate, butyl methacrylate, isobutyl methacrylate, 2-ethylhexyl methacrylate, decyl methacrylate, lauryl methacrylate, isobornyl methacrylate, isodecyl methacrylate, oleyl methacrylate, palmityl methacrylate, stearyl methacrylate, hydroxyethyl methacrylate, and hydroxypropyl methacrylate; methacrylamide or substituted methacrylamides; styrene or substituted styrenes; vinyl acetate; vinyl ester of "Versatic" acid (a tertiary monocarboxylic acid having C9, C10 and C11 chain length, the vinyl ester is also known as "vinyl versataten); amino monomers, such as, for example, N,N'-dimethylamino methacrylate; methacrylonitrile. Additionally copolymerizable ethylenically-unsaturated acid monomers in the range of, for example, 0.1% to 10%, by weight based on the weight of the emulsion polymerized polymer, acrylic acid, methacrylic acid, crotonic acid, itaconic acid, fumaric acid, maleic acid, monomethyl itaconate, monomethyl fumarate, monobutyl fumarate, maleic anhydride, 2-acrylamido-2-methyl-1-propanesulfonic acid, sodium vinyl sulfonate, and phosphoethyl methacrylate, may be used.

Some of the more preferred such homopolymers or copolymers include at least one ethylenically unsaturated monomer, such as, for example, methacrylic ester monomers including ethyl methacrylate, propyl methacrylate, butyl methacrylate, isobutyl methacrylate, 2-ethylhexyl methacrylate, decyl methacrylate, lauryl methacrylate, isodecyl methacrylate, oleyl methacrylate, palmityl methacrylate, stearyl methacrylate, hydroxyethyl methacrylate, and hydroxypropyl methacrylate; methacrylamide or substituted methacrylamides; substituted styrenes. Additionally copolymerizable ethylenically-unsaturated acid monomers in the range of, for example, 0.1% to 5%, by weight based on the weight of the emulsion polymerized polymer, acrylic acid, methacrylic acid may also be used.

Some of the most preferred such homopolymers or copolymers include at least one ethylenically unsaturated monomer, such as, for example, alpha-methyl styrene and methacrylic ester monomers including ethyl methacrylate, butyl methacrylate, isobutyl methacrylate and propyl methacrylate. Additionally copolymerizable ethylenically-unsaturated acid monomers in the range of, for example, 0.1% to 5%, by weight based on the weight of the emulsion polymerized polymer methacrylic acid.

The aqueous dispersion of the polymer particles of the abalative layer or the binder in the luminophor layer of the present invention are produced by emulsion polymerization. Either thermal or redox initiation processes may be used.

The polymerization process is typically initiated by conventional combustible free radical initiators, such as, for example, hydrogen peroxide, benzoyl peroxide, t-butyl hydroperoxide, t-butyl peroctoate, ammonium persulfates, typically at a level of 0.05 percent to 3.0 percent by weight, all weight percentages based on the weight of total monomer. Redox systems using the same initiators coupled with a suitable combustible reductant such as, for example, ammonium bisulfite, sodium hydrosulfite and ascorbic acid, may be used at similar levels.

The polymer particle size is controlled by the amount of surfactants added during the emulsion polymerization process. As a stated earlier, the inventors discovered that by using combustible surfactants, the ash content in the polymer particles or the binder of the resulting ablative layer and luminophor layer, respectively, is reduced. Typical combustible anionic emulsifiers include carboxylic polymers and copolymers of the appropriate hydrophile-lipophile balance, ammonium alkyl sulfates, alkyl sulfonic acids, fatty acids, oxyethylated alkyl phenol sulfates and ammonium salts thereof. Ammonium salts are preferred. Ammonium lauryl sulfate is more preferred. Typical nonionic combustible emulsifiers include alkyl phenol ethoxylates, polyoxyethylenated alkyl alcohols, amine polyglycol condensates, modified polyethoxy adducts, long chain carboxylic acid esters, modified terminated alkylaryl ether, and alkylpolyether alcohols. Typical ranges for surfactants are between 0.1 to 6, preferably by 0.1 to 2, and more preferably 0.6 to 1.5 percent by weight based on total weight of total monomer.

In yet another aspect, the method of the present invention is directed to reducing the number of baking steps used in producing CRT from a conventional two-step bake process to a novel one step bake process in which the volatilization of the binder in the luminophor layer and the ablative layer is combined with the step of sealing the face plate of the CRT to the cone of the CRT. One of the major impediment in combining these two steps is the deleterious effect of the volatilized gases produced during the volatilization of the binder in the luminophor layer and the ablative layer on a glass sealant, such as, a CRT sealing frit (glass powder), used in cementing the face plate to the cone of the CRT. The CRT sealing glass frits are well known in the art, such as, those supplied by Corning Glass Company, Corning, N.Y. It is believed, without reliance thereon, that the volatilizing gases tend to chemically attack the sealant, thereby adversely affecting the quality of the hermitic seal required for proper functioning of a typically CRT, which is kept under a high degree of vacuum. The inventors of the present invention have unexpectedly discovered that by utilizing combustible polymers in the binder of the luminophor layer or the ablative layer that substantially volatilize at 5° C. to 80° C. degrees below the softening point of the sealant, hermitic seals of desired quality are produced by the sealant, when the baking temperature is ramped up to the softening point of the sealant, which generally tends to be in the range of 380° C. to 600° C. The softening point of the sealant is adjusted in accordance with the type of glass used in producing the face plate or the cone of the CRT.

The method of the present invention is also suitable for producing a monochromatic luminescent screens, such as, those used as computer screens, or black-and-white television sets.

The following test procedures were used for evaluating the polymer composition used in the method of the present invention:

Measurement of Ash Content

The ash content of Examples, described below, were measured by thermogravimetric analysis performed on TGA-500, model No. 602-400 manufactured by LECO Corporation, 3000 Lakeview Ave., St. Joseph, Mich. 49085-2396.

Procedure: 1±0.5 g of samples of Examples, described below, were put in crucibles and then gradually heated in series of steps from room temperature until the crucible contents reached 825° C. with intermediate periods during which the temperature was held steady for permitting the crucible contents to equilibrate. The temperature was ramped from room temperature to 100° C. at a rate of 99° C. per minute, then to 150° C. at a rate of 10° C. per minute, then to 425° C. at a rate of 10° C. per minutes and finally to 825° C. at a rate of 10° C. per minute. Acceptable low ash content means ash content in the range of 0 to 0.6 percent, preferably 0 to 0.3 percent, all in weight percentages based on the total weight polymer solids.

Surface Distortions of Ablative Layer

The measurement of the degree of surface distortions produced on the ablative layer were conducted by measuring the degree of gloss obtained on the coating produced by the polymer particles of the present invention as compared to a comparative polymer being used currently. The gloss of a coating is a measurement of the smoothness of the surface of the coating. A coating with a higher gloss measurement has a smoother surface.

Procedure: The aqueous dispersion polymer particles made in accordance with the procedure described below, were mixed with 10 percent by weight, based on the total polymer solids weight, of Texanol® ester alcohol, which is supplied by Eastman Chemicals Company, Kingsport, Tenn. DI water was added to adjust the total percentage of solids in the aqueous dispersion to 36.5 percent total solids. The dispersions were stirred for 20 minutes with a magnetic stirrer and then allowed to stand overnight. Each dispersion was then applied over a black linetta chart to a thickness of 10 and 20 mil film thicknesses. The resultant films were dried in an oven at 60° C. for one hour. The coated linetta charts were stored under ambient conditions for 24 hours before measuring the gloss by means of Gardner Glossgard II glossmeter manufactured by Paul N. Gardner Company, Pompano Beach, Fla. Acceptable degree of surface smoothness, expressed as gloss, means gloss of more than 5 when measured at 20° and more than 50 when measured at 60° using Gardner Glossgard II glossmeter.

Some of the embodiments of the invention will now be described in detail in the following Examples.

EXAMPLE 1

A four-necked, 5 liter round-bottom flask, equipped with a condenser, stirrer and thermometer was charged with 950 grams of deionized water and 1.4 g of surfactant (Ammonium lauryl sulfate, @ 27.5% total solids). The flask was heated to 85° C. under Nitrogen.

A monomer emulsion mixture, described in Table 1 below, was prepared:

TABLE 1

| Quantity | Material |
|---|---|
| 225 grams | Deionized Water |
| 26.7 grams | Ammonium lauryl sulfate (27.5% solids). |
| 18 grams | Methacrylic Acid (MAA) |
| 10 grams | Deionized water rinse for methacrylic acid container. |
| 758 grams | Butyl methacrylate (BMA) |
| 25 grams | Deionized water rinse for Butyl methacrylate container. |

Twenty grams of the monomer emulsion mixture was added to the flask. The transfer container was rinsed with 25 g of deionized water, which was then added to the flask. A solution of 1.2 g of ammonium persulfate dissolved in 15 g of deionized water was added to the flask. After 15 minutes, the remaining monomer emulsion mixture and 1.2 g of ammonium persulfate dissolved in 50 g of deionized water were gradually added to the flask over 180 minutes. After the addition was completed, the monomer mixture emulsion and catalyst containers were rinsed with a total of 35 grams of deionized water, which was then added to the flask. After 30 minutes, the flask was allowed to cool. While the flask was cooling, 0.58 grams of a 0.15% solution of Iron (II) sulfate heptahydrate was added to the flask. A solution of 0.58 grams of sodium hydrosulfite in 15 grams of deionized water and a solution of 0.1 grams of t-butyl hydroperoxide (70% active) in 15 grams of water was added to the flask. The resulting polymer had particle size of 262 nm and 38.5% total solids.

EXAMPLE 2–8

The same procedure as that used for preparing Example 1, was used in preparing Examples 2–8 by utilizing the monomer emulsion mixtures described in Table 2 below:

TABLE 2

| Example | 2 | 3 | 4 | 5 | 6 | 7 | 8 |
|---|---|---|---|---|---|---|---|
| Surfactant | #1 | #1 | #2 | #1 | #1 | #1 | #1 |
| Surfactant in flask (grams) | 11.8 | 0.2 | 11 | 42.8 | 0.2 | 0.8 | 0.85 |
| Surfactant in monomer emulsion (grams) | 4.35 | 16.1 | 16.5 | 8.5 | 16.8 | 16.2 | 16 |
| Monomers | | | | | | | |
| BMA | 758 | 758 | 758 | 758 | | | 758 |
| MAA | 18 | 18 | 18 | 18 | 18 | 18 | 18 |
| Ethyl methacrylate (EA) | | | | | 434 | 434 | |
| Methyl methacrylate (MMA) | | | | | 324 | 324 | |
| Properties | | | | | | | |
| Particle size (nm) | 110 | 294 | 94 | 83 | 242 | 163 | 184 |
| Percent total solids | 39.1 | 39.5 | 38.4 | 38.3 | 38.5 | 38.5 | 38.8 |

Surfactant #1 was sodium dodecyl diphenyl oxide disulfonate (45% solids).
Surfactant #2 was ammonium lauryl sulfate (27.5% solids).

The effect of particle size of a polymer on the gloss obtained therefrom was measured and tabulated in Table 3 below:

TABLE 3

| Example | 2 | 8 | 3 | 4 | 6 |
|---|---|---|---|---|---|
| Particle Size (nm) | 110 | 184 | 294 | 94 | 262 |
| Surfactant used | #1 | #1 | #1 | #2 | #1 |
| Gloss 60° | | | | | |
| 10 mils thick film | 26 | 88 | 62 | 18 | 81 |
| 20 mils thick film | 52 | 89 | 68 | 39 | 68 |
| Gloss 20° | | | | | |
| 10 mils thick film | 1 | 36 | 9 | 1 | 10 |
| 20 mils thick film | 1 | 54 | 9 | 1 | 9 |

Surfactant #1 was sodium dodecyl diphenyl oxide disulfontate (45% solids).
Surfactant #2 was ammonium lauryl sulfate (27.5% solids).

The data in Table 3 shows that as the particle size of a polymer was increased, the gloss of a coating prepared therefrom also improved (higher reading represents higher gloss). This held true regardless of how the gloss was measured, i.e., at 60° or 20° angle. When the particle size of the polymer particle was less than 180 nm (Examples 2 and 4), the gloss of the coating prepared from the polymer was unacceptably low (less than 5 when measured at 20° and less than 50 when measured at 60°), indicating a rough or uneven surface. When the particle size of the polymer particle was greater than or equal to 180 nm (Examples 3, 6 and 8), the gloss of the coating prepared from such a polymer was found to be acceptable (more than 5 when measured at 20° and more than 50 when measured at 60°).

The effect of the surfactant on the ash content was measured by the thermogravimetric analysis described earlier. The results of the analysis are tabulated below in Table 4:

TABLE 4

| Example | Surfactant | Grams of Solid Surfactant | Composition | Ash (Average of 2 analysis) |
|---|---|---|---|---|
| 3 | #1 | 7.3 | BMA | 0.48% |
| 4 | #2 | 7.6 | BMA | 0.17% |
| 5 | #1 | 23.1 | BMA | 0.70% |

Surfactant #1 was sodium dodecyl diphenyl oxide disulfonate.
Surfactant #2 was ammonium lauryl sulfate.

The data in table 4 shows that the ash content in the polymer is dependent upon the combustibility of additives present in the polymer. For example, by comparing the ash content in Examples 3 and 4, it is seen that the ash content depended upon the type of cation in the surfactant. The polymer prepared with a surfactant having an ammonium cation (surfactant #2) had a lower ash level than a polymer prepared having a sodium cation (surfactant #1). Furthermore, by comparing Examples 3 and 5, it is seen that the ash content increased as the level of surfactant present in the polymer was increased. Thus, higher amount of surfactant present in Example 5, resulted in the ash content at unacceptable levels (0.70%). By contrast, lower amount of surfactant present in Example 3, resulted in the ash content at acceptable levels (0.48%).

The data in Table 5 shows the effect of the types of monomers used in preparing the polymers in the ablative layer and the binder of the luminophor layer on the weight amount of polymers thermally decomposing at a given temperature. For example, the amount in percent by weight of the polymer that thermally decomposed at a given temperature was significantly higher in Examples 3 and 8 (prepared from a monomer mixture of BMA and MAA) than Examples 6 and 7 (prepared from a monomer mixture of EA, MMA and MAA). Thus, for example, at 400° C., more than 15 percent by weight, based on the total weight of polymer solids of Examples 3 and 8, thermally decomposed. By comparison, less than 5 percent by weight, based on the total weight of polymer solids of Examples 6 and 7, thermally decomposed. The rate of decomposition was not significantly affected by the particle size of the polymer particles, as seen by comparing Examples 3 and 6 having larger particle size against Examples 7 and 8 having smaller particle size.

Thus, it is seen lowering the decomposition temperature of polymers used in the binder in the luminophor layer and the ablative layer, such polymers can be volatilized at temperatures below the softening point of the sealant used in cementing the face plate of CRT to the cone of the CRT. As a result, as the baking temperature at which the volatilizing step is conducted is lowered, the gases produced by during the decomposition can be scavenged before the temperature is ramped up to a temperature at which the cementing of the face plate with the cone takes place.

TABLE 5

| Decomposition Temperature in ° C. | Example 6 Amount Decomposed in weight percent | Example 3 Amount Decomposed in weight percent | Example 7 Amount Decomposed in weight percent | Example 8 Amount Decomposed in weight percent |
|---|---|---|---|---|
| 300 | 0.0 | 0.0 | 0.0 | 0.0 |
| 305 | 0.0 | 0.0 | 0.0 | 0.0 |
| 310 | 0.0 | 0.0 | 0.0 | 0.0 |
| 315 | 0.0 | 0.3 | 0.0 | 0.4 |
| 320 | 0.0 | 0.6 | 0.0 | 0.5 |
| 325 | 0.0 | 0.8 | 0.0 | 0.6 |
| 330 | 0.0 | 0.9 | 0.0 | 0.7 |
| 335 | 0.0 | 1.2 | 0.0 | 0.7 |
| 340 | 0.4 | 1.6 | 0.0 | 0.8 |
| 345 | 0.4 | 1.9 | 0.1 | 1.1 |
| 350 | 0.5 | 2.5 | 0.4 | 2.2 |
| 355 | 0.6 | 3.8 | 0.8 | 2.7 |
| 360 | 0.9 | 4.4 | 0.8 | 3.1 |
| 365 | 1.2 | 4.7 | 1.2 | 4.2 |
| 370 | 1.6 | 5.3 | 1.5 | 5.8 |
| 375 | 2.2 | 6.4 | 1.5 | 6.9 |
| 380 | 2.5 | 7.5 | 1.9 | 8.8 |
| 385 | 2.8 | 9.0 | 2.3 | 10.4 |
| 390 | 3.4 | 10.9 | 2.3 | 12.3 |
| 395 | 4.0 | 13.1 | 3.1 | 14.2 |
| 400 | 4.7 | 15.3 | 3.5 | 16.5 |
| 405 | 5.6 | 17.8 | 4.6 | 18.8 |
| 410 | 7.5 | 20.9 | 6.2 | 21.9 |
| 415 | 9.7 | 25.0 | 7.7 | 26.5 |
| 420 | 13.8 | 33.1 | 11.5 | 34.6 |
| 425 | 23.8 | 51.9 | 23.0 | 53.8 |
| 430 | 99.5 | 99.6 | 99.6 | 99.6 |

What is claimed is:

1. A method for reducing surface distortions in a reflective aluminum film of a luminescent layer of a CRT comprising:

coating a luminophor layer deposited on a face plate of said CRT with an ablative layer of an aqueous dispersion of acrylic polymer particles having a particle size in the range of 180 to 450 nanometers for reducing surface distortions on said ablative layer; and depositing said reflective aluminum film on said ablative layer, wherein said reflective film conforms to said ablative layer.

2. The method of claim 1 further comprising volatilizing said ablative layer, wherein said acrylic polymer particles comprise combustible components for reducing ash content in said luminescent layer.

3. The method of claim 2, further comprising:

applying, before said volatilizing step, a sealant along the edge of said face plate and then positioning a CRT cone thereon;

conducting said volatilizing step at a baking temperature below the softening point of said sealant; and raising said baking temperature above the softening point of said sealant to cement said cone to said face plate.

4. A method for producing a CRT having improved image quality comprising:

reducing an ash content in a luminescent layer of said CRT to enhance the brightness of all image produced by said CRT and reducing surface distortions in a reflective aluminum film of said luminescent layer to reduce distortions in said image produced by said CRT;

said step of reducing said ash content in said luminescent layer of said CRT comprising:

depositing on a face plate of said CRT a luminophor layer comprising an array of phosphor particles and a combustible acrylic binder;

coating said luminophor layer with an ablative layer of anl aqueous dispersion of combustible polymer particles, wherein said binder of said luminophor layer and said particles of said ablative layer are colloidally stabilized with ammonium lauryl sulfate; and said step of for reducing said surface distortions in said reflective aluminum film comprising controlling particle size of said acrylic polymer particles within the range of 180 to 450 nanometers.

5. The method of claim 4 further comprising:

drying said phosphor layer having said ablative layer coated thereon;

depositing said reflective aluminum film on said exposed surface of said ablative layer, wherein said reflective aluminum film conforms to said exposed surface of said ablative layer having reduced surface distortions;

applying a sealant along the edge of said face plate and then positioning a CRT cone thereon;

volatilizing said binder in said luminophor layer and said ablative layer at a baking temperature below softening point of said sealant to produce said luminescent layer having reduced ash content and having said reflective aluminum film having reduced surface distortions; and raising said baking temperature above the softening point of said sealant to cement said cone to said face plate to produce said CRT having improved image quality.

6. A method of baking a luminescent layer of a CRT applied along the inner surface of a face plate of said CRT comprising:

applying a sealant along the edge of said face plate of said CRT and then positioning a CRT cone of said CRT thereon;

volatilizing a binder in a luminophor layer of said luminescent layer and an ablative layer of said luminescent layer at a baking temperature below the softening point of said sealant; and raising said baking temperature above the softening point of said sealant to cement said cone to said face plate to produce said CRT.

7. A method for producing a CRT having improved image quality comprising:

reducing an ash content in a luminescent layer of said CRT to enhance the brightness of an image produced by said CRT and reducing surface distortions in a reflective aluminum film of said luminescent layer to reduce distortions in said image produced by said CRT;

said step of reducing said ash content in said luminescent layer of said CRT comprising:

depositing on a face plate of said CRT a luminophor layer comprising an array of phosphor particles and a combustible acrylic binder;

coating said luminophor layer with an ablative layer of an aqueous dispersion of combustible polymer particles, wherein said binder of said luminophor layer and said particles of said ablative layer are colloidally stabilized with an emulsifier selected from the group consisting of ammonium alkyl sulfates, alkyl sulfonic acids, fatty acids, oxyethylated alkyl phenol sulfates and ammonium salts thereof, alkyl phenol ethoxylates, polyoxyethylenated alkyl alcohols, amine polyglycol condensates, modified polyethoxy adducts, modified terminated alkylaryl ether, and alkylpolyether alcohols; and said step of for reducing said surface distortions in said reflective aluminum film comprising controlling particle size of said acrylic polymer particles within the range of 180 to 450 nanometers.

8. The method of claim 7 further comprising:

drying said phosphor layer having said ablative layer coated thereon;

depositing said reflective aluminum film on said exposed surface of said ablative layer, wherein said reflective aluminum film conforms to said exposed surface of said ablative layer having reduced surface distortions;

applying a sealant along the edge of said face plate and then positioning a CRT cone thereon;

volatilizing said binder in said luminophor layer and said ablative layer at a baking temperature below softening point of said sealant to produce said luminescent layer having reduced ash content and having said reflective aluminum film having reduced surface distortions; and raising said baking temperature above the softening point of said sealant to cement said cone to said face plate to produce said CRT having improved image quality.

* * * * *